US008907860B2

(12) United States Patent
Lee et al.

(10) Patent No.: US 8,907,860 B2
(45) Date of Patent: Dec. 9, 2014

(54) STAND-ALONE MULTI-BAND ANTENNA

(75) Inventors: Cheng-Tse Lee, Jiaoxi Township, Yilan County (TW); Saou-Wen Su, Keelung (TW)

(73) Assignees: Lite-On Electronics (Guangzhou) Limited, Guangzhou (CN); Lite-On Technology Corporation, Taipei (TW)

( * ) Notice: Subject to any disclaimer, the term of this patent is extended or adjusted under 35 U.S.C. 154(b) by 409 days.

(21) Appl. No.: 13/049,284

(22) Filed: Mar. 16, 2011

(65) Prior Publication Data

US 2012/0146874 A1 Jun. 14, 2012

(30) Foreign Application Priority Data

Dec. 31, 2010 (CN) ..... 2010 1 0623325

(51) Int. Cl.
*H01Q 1/52* (2006.01)
*H01Q 5/00* (2006.01)
*H01Q 9/04* (2006.01)

(52) U.S. Cl.
CPC ..... *H01Q 1/52* (2013.01); *H01Q 5/0027* (2013.01); *H01Q 9/0407* (2013.01); *H01Q 5/0062* (2013.01)
USPC ..... 343/841

(58) Field of Classification Search
CPC ..... H01Q 5/00; H01Q 5/0003; H01Q 5/001; H01Q 5/0024; H01Q 5/0027; H01Q 5/0051; H01Q 5/0055; H01Q 5/0058; H01Q 5/0062; H01Q 9/0421; H01Q 9/04; H01Q 9/0407; H01Q 1/22; H01Q 1/24; H01Q 1/241; H01Q 1/242; H01Q 1/243; H01Q 1/245; H01Q 1/2258; H01Q 1/2266; H01Q 1/2275; H01Q 1/2291
USPC ..... 343/700 MS, 702, 841
See application file for complete search history.

(56) References Cited

U.S. PATENT DOCUMENTS

| | | | | |
|---|---|---|---|---|
| 5,767,810 | A * | 6/1998 | Hagiwara et al. | 343/700 MS |
| 6,114,996 | A * | 9/2000 | Nghiem | 343/700 MS |
| 6,856,285 | B2 * | 2/2005 | Bettin et al. | 343/700 MS |
| 7,764,238 | B2 * | 7/2010 | Hotta et al. | 343/702 |

(Continued)

FOREIGN PATENT DOCUMENTS

| | | | |
|---|---|---|---|
| CN | 1650473 | A | 8/2005 |
| CN | 101764282 | A | 6/2010 |
| TW | I277243 | B | 3/2007 |
| TW | M377714 | | 4/2010 |

*Primary Examiner* — Hoang V Nguyen
*Assistant Examiner* — Patrick Holecek
(74) *Attorney, Agent, or Firm* — Li & Cai Intellectual Property (USA) Office

(57) ABSTRACT

A stand-alone multi-band antenna includes an antenna ground plate, a shielding metal wall, a first radiating unit, and a signal feed-in source. The first radiating unit connected to at least one side of the antenna ground plate and located above the antenna ground plate is an antenna structure generating the fringing-field. The first radiating unit provides a first operating band and a second operating band. The shielding metal wall is connected to a plurality of the adjacent sides of the antenna ground plate, and the height thereof is larger than or equal to that of the first radiating unit, therefore limiting the fringing-field of the first radiating unit within the stand-alone multi-band antenna. The signal feed-in source has a signal feed-in point and a ground point. The signal feed-in point is electrically connected to the first radiating unit, and the ground point is electrically connected to the shielding metal wall.

19 Claims, 13 Drawing Sheets

(56) References Cited

U.S. PATENT DOCUMENTS 7,782,270 B2 8/2010 Chung et al.
7,920,095 B2 * 4/2011 Wei ..... 343/700 MS
2003/0234742 A1 * 12/2003 Tai et al. ..... 343/700 MS
2009/0033557 A1 2/2009 Wei
2010/0283704 A1 11/2010 Hotta et al.

* cited by examiner

STAND-ALONE MULTI-BAND ANTENNA

BACKGROUND

1. Technical Field

The present disclosure relates to an antenna, in particular, to stand-alone multi-band antenna.

2. Description of Related Art

Most of conventional embedded antennas are designed to be planar inverted-F antenna (PIFA) or monopole antenna, and these two-type antennas must have corresponding ground plates to radiate, such that the antenna can have the good impedance matching and the good radiation performances. Generally speaking, the antenna ground plate is usually the system ground plate of the electronic device, and the system ground plate is used for the layout of the electronic elements. When the displacement of the electronic elements on the system ground plate is changed, the dimension and the shape of the system ground plate may change as well. In other words, the impedance and radiation performances of the antenna will be influenced corresponding to the system ground plate.

For the antenna designer, he or she not only designs the antenna pattern, but also takes the other factors, such as the dimension and the shape of the system ground plate, into the design consideration, such that the design complexity of the antenna is increased dramatically. In the development of the current antenna design, it is understood that stand-alone antenna is gradually applied in the electronic device of the network communication field. The advantage of the stand-alone antenna is that the stand-alone antenna can generate the required operating band without any additional antenna ground plate. However, the stand-alone antenna is easy to be affected by the ambient environment, and in particular, when the metal element exists nearby the stand-alone antenna, the impedance and radiation performances of the stand-alone antenna would be affected dramatically.

Some stand-alone antennas with multi-band operation have been published. Taiwanese Patent No. M377714 discloses the PIFA-typed stand-alone antenna with multi-band operation having dual paths. Furthermore, the conventional multi-band antenna has the simple structure, and therefore the conventional multi-band antenna is easy to be implemented. However, according to the properties of the planar inverted-F antenna, it is known that the current distribution on the terminal end of the resonant path is weaker than that on the other location, in other words the electrical field on the terminal end of the resonant path is larger than that on the other location, and therefore the fringing-field effects will be generated. When the object (especially, the metal object) is nearby the conventional multi-band antenna, the fringing-field of the conventional multi-band antenna and the nearby object are mutually coupled to each other, and therefore the impedance and radiation performances of the conventional multi-band antenna are dramatically affected. Due to the properties of the conventional multi-band antenna, the arrangement location of the conventional multi-band antenna is limited by the inner environment of the electronic device, and the practical application value of the conventional multi-band antenna is thus reduced.

SUMMARY

An exemplary embodiment of the present disclosure provides a stand-alone multi-band antenna, and the stand-alone multi-band antenna comprises an antenna ground plate, a shielding metal wall, a first radiating unit, and signal feed-in source. The first radiating unit is an antenna structure generating a fringing-field. The first radiating unit is connected to at least one side of the antenna ground plate and located above the antenna ground plate. The first radiating unit is used to provide a first operating band and a second operating band. The shielding metal wall is connected to a plurality of the adjacent sides of the antenna ground plate, wherein a height of the shielding metal wall is larger than or equal to a height of the first radiating unit, such that the fringing-field of the first radiating unit is limited within the stand-alone multi-band antenna. The signal feed-in source has a signal feed-in point and a ground point, wherein the signal feed-in point is electrically connected to the first radiating unit, and the ground point is electrically connected to the shielding metal wall.

An exemplary embodiment of the present disclosure provides a stand-alone multi-band antenna, and the stand-alone multi-band antenna comprises an antenna ground plate, a shielding metal wall, a first radiating unit, and signal feed-in source. The first radiating unit is an antenna structure generating a fringing-field. The first radiating unit is connected to at least one side of the antenna ground plate and located above the antenna ground plate. The first radiating unit is used to provide a first operating band and a second operating band. The shielding metal wall is connected to a plurality of the adjacent sides of the antenna ground plate, wherein a height of the shielding metal wall is corresponding to a specific distance between the first radiating unit and shielding metal wall, so as to limit the fringing-field of the first radiating unit in the stand-alone multi-band antenna. The signal feed-in source has a signal feed-in point and a ground point, wherein the signal feed-in point is electrically connected to the first radiating unit, and the ground point is electrically connected to the shielding metal wall.

To sum up, the stand-alone multi-band antenna has the shielding metal wall, and the shielding metal wall can effectively limit the fringing-field of the stand-alone multi-band antenna within the main structure of the stand-alone multi-band antenna, so as to reduce the mutual coupling between the fringing-field and the element nearby the stand-alone multi-band antenna. Accordingly, the stand-alone multi-band antenna has the ability for resisting the effect due to the variation of the ambient environment.

In order to further understand the techniques, means and effects the present disclosure, the following detailed descriptions and appended drawings are hereby referred, such that, through which, the purposes, features and aspects of the present disclosure can be thoroughly and concretely appreciated; however, the appended drawings are merely provided for reference and illustration, without any intention to be used for limiting the present disclosure.

DESCRIPTION OF THE EXEMPLARY EMBODIMENTS

A stand-alone multi-band antenna according to an exemplary embodiment of the present disclosure can be integrated and embedded in one electronic device of the different network communication products, and can be designed to provide a 2.4 GHz (2400~2484 MHz) operating band, a 5.2 GHz (5150~5350 MHz) operating band, and a 5.8 GHz (5725~5825 MHz) operating band, wherein these three operating bands are served as the communication band of the electronic device. In addition, a stand-alone multi-band antenna can be is formed a metal sheet having a plurality of bendings. Different stand-alone antennas according to exemplary embodiments of the present disclosure are illustrated as follows.

[Exemplary Embodiment of Stand-Alone Multi-Band Antenna]

Figure 1:
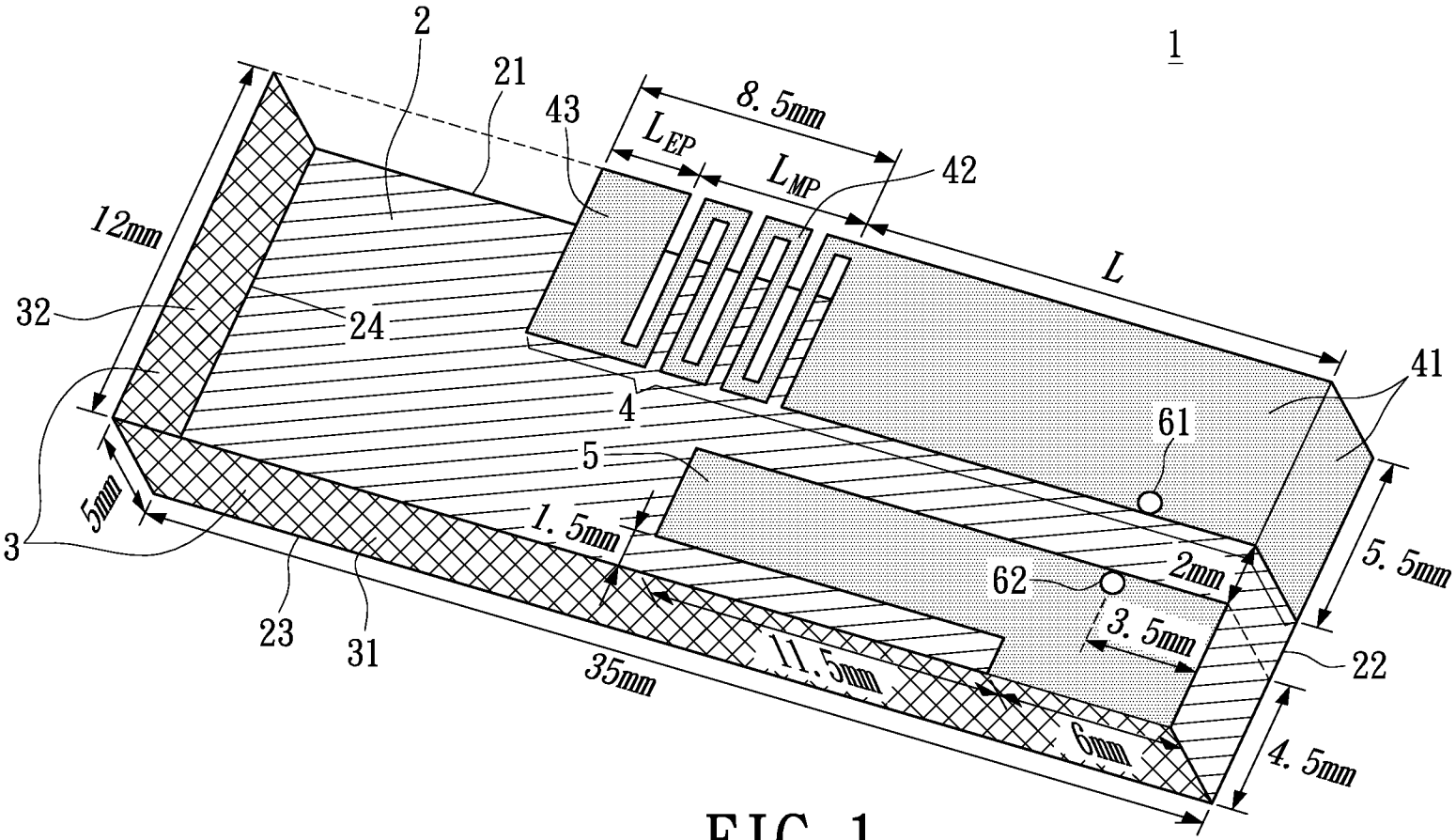
FIG. 1 is a three dimension diagram showing a stand-alone multi-band antenna according to an exemplary embodiment of the present disclosure.

Referring to FIG. 1, FIG. 1 is a three dimension diagram showing a stand-alone multi-band antenna according to an exemplary embodiment of the present disclosure. The stand-alone multi-band antenna 1 comprises an antenna ground plate 2, a shielding metal wall 3, a first radiating unit 4, a second radiating unit 5, a signal feed-in point 61, and a ground point 62. The stand-alone multi-band antenna 1 is an independently operable multi-band antenna, and is formed a metal sheet having a plurality of bendings, and the thickness of the metal sheet is 0.3 millimeter, but the thickness of the metal sheet is not used to limit the present disclosure. The structure of the first radiating unit 4 is substantially the structure of the planar inverted-F antenna, and the second radiating unit 5 can be a parasitic metal plate.

Due to the fringing-field generated on the terminal end of the first radiating unit 4 of the stand-alone multi-band antenna 1, the shielding metal wall 3 is located on the side of antenna ground plate 2 and nearby the terminal end of the first radiating unit 4, such that the fringing-field is limited within the stand-alone multi-band antenna 1. Accordingly, when the metal object is nearby the stand-alone multi-band antenna 1, the mutual coupling between the stand-alone multi-band antenna 1 and the metal object is reduced.

In short, the vertical shielding metal wall 3 of the stand-alone multi-band antenna 1 can efficiently limit the fringing-field of the planar inverted-F antenna within the main structure of the stand-alone multi-band antenna 1, such that the mutual coupling among the fringing-field and the other elements nearby the stand-alone multi-band antenna 1 is reduced. Thus, the stand-alone multi-band antenna 1 has the ability for resisting the effect due to the variation of the ambient environment.

The detailed structure of the stand-alone multi-band antenna 1 in FIG. 1 is illustrated as follows. However, the structure of the stand-alone multi-band antenna in the present disclosure is not limited thereto. FIG. 1 is used to illustrate one exemplary embodiment, and the other stand-alone multi-band antennas having the shielding metal walls to limit the fringing-fields within the main structures of the stand-alone multi-band antennas are illustrated in the other exemplary embodiments.

In the exemplary embodiment of the FIG. 1, the rectangular antenna ground plate 2 has a first long side 21, a first short side 22, a second long side 23, and a second short side 24, wherein the first long side 21 and the second long side 23 are neighboring to the first short side 22 and the second short side 24, the first long side 21 is opposite to the second long side 23, and the first short side 22 is opposite to the second short side 24. The shielding metal wall 3 is formed by a part of the extending metal sheet of the antenna ground plate 2, and the shielding metal wall 3 and the antenna ground plate 2 are vertical to each other. To put it more precisely, the shielding metal wall 3 is formed by an L-shaped metal wall extended from the second long side 23 and the second short side 24. The shielding metal wall 3 comprises a first shielding part 31 and a second shielding part 32, wherein the first shielding part 31 and the second shielding part 32 are adjacently connected to each other. The first shielding part 31 is connected to the second long side 23, the second shielding part 32 is connected to the second short side 24, and the first shielding part 31 and the second shielding part 32 are vertical to the antenna ground plate 2. Furthermore, it is noted that the first shielding part 31 and the second shielding part 32 may be merely adjacent to each other but not connected to each other in the other one exemplary embodiment.

The first radiating unit 4 is located above the antenna ground plate 2. One end of the first radiating unit 4 is connected to the first short side 22, and the first radiating unit 4 is extending with the first long side 21. The first radiating unit 4 is used to provide a first operating band and a second operating band. The first radiating unit 4 comprises a first metal part 41, a meandering metal part 42, and a second metal part 43, wherein the meandering metal part 42 is connected between the first metal part 41 and the second metal part 43, and one end of the first metal part 41 is connected to the first short side 22.

The first metal part 41 has at least one bending, such that one end of the first metal part 41 is connected to the first short side 22, and a part of the first metal part 41 is extending along with the first long side 21 (i.e. extending to the second short side 24). In short, the first metal part 41 is bent to be an L-shaped metal sheet. The meandering metal part 42 has a plurality of meandering lines, wherein the meandering lines has at least three beadings. One end of the meandering metal part 42 is connected to one side of the first metal part 41, and the other end of the meandering metal part 42 is connected to one side of the second metal part 43. The second metal part 43 is located on the extension direction of the first metal part 41.

One end of the second radiating unit 5 is connected to the first shielding part 31 of the shielding metal wall 3, and the second radiating unit 5 can be an L-shaped metal sheet. One end of the second radiating unit 5 is extending to the first short side 22, and the main body of the second radiating unit 5 is extending along with the second long side 23 (i.e. extending to the second short side 24). The second radiating unit 5 is used to provide a third operating band.

In the exemplary embodiment of FIG. 1, the signal feed-in point 61 is located on the first metal part 41, the ground point 62 is located on the second radiating unit 5, and the signal feed-in point 61 and the ground point 62 are located on the neighboring sides of the first metal part 41 and the second radiating unit 5. The ground point 62 is electrically connected to the shielding metal wall 3 through the second radiating unit 5. The signal feed-in source of the stand-alone multi-band antenna 1 is formed by the signal feed-in point 61 and the ground point 62. The electronic device may be electrically connected to the stand-alone multi-band antenna 1 through the signal feed-in transmission line, wherein the signal feed-in transmission line may be a mini-coaxial line for example. The signal feed-in point 61 (i.e. the radio frequency signal output end) of the signal feed-in source is electrically connected to the first radiating unit 4, and the ground point 62 of the signal feed-in source is electrically connected to the second radiating unit 5 (or electrically connected to the shielding metal wall 3 through the second radiating unit 5).

The dimensions, such as lengths, widths, and distances, of the elements of the stand-alone multi-band antenna 1 in FIG. 1 are illustrated as follows. However, the dimensions, such as lengths, widths, and distances, of the elements of the stand-alone multi-band antenna 1 in FIG. 1 are not used to limit the present disclosure thereto, and FIG. 1 is just one exemplary embodiment.

In the exemplary embodiment of FIG. 1, the lengths of the first long side 21 and second long side 23 are 35 millimeters, and the lengths of the first short side 22 and the second short side 24 are 12 millimeters. The length and the height of the first shielding part 31 are respectively 35 millimeters and 5 millimeters, and the length and the height of the second shielding part 32 are 12 millimeters and 5 millimeters.

The length of first metal part 41 connected to one end of the first short side 22 is 5.5 millimeters, and the length of the first metal part 41 extending along with the first long side 21 is L. The length of the meandering metal part 42 extending along with the first long side 21 is $L_{MP}$, the length of the second metal part 43 extending with the first long side 21 is $L_{EP}$, and the summation length of the lengths $L_{MP}$ and $L_{EP}$ is 8.5 millimeters. In addition, the line width of the meandering line is 0.5 millimeter (referring to FIG. 2), and the distances between the meandering lines is also 0.5 millimeter (referring to FIG. 2).

The distance between the second radiating unit 5 and the first radiating unit 4 is 2 millimeters, and the length of the side of the second radiating unit 5 connected to the first shielding part 31 is 6 millimeters. The length of the main body of the second radiating unit 5 is 17.5 (i.e. 11.5+6) millimeters, and the distance between the main body of the second radiating unit 5 and the first shielding part 31 is 1.5 millimeters. The width of the main body of the second radiating unit 5 is 3 (i.e. 4.5−1.5) millimeters. The distance between the projection of the signal feed-in point 61 on the antenna ground plate 2 and the first short side 21 is 3.5 millimeters, and distance between the projection of the ground point 62 on the antenna ground plate 2 and the first short side 21 is also 3.5 millimeters.

Figure 2:
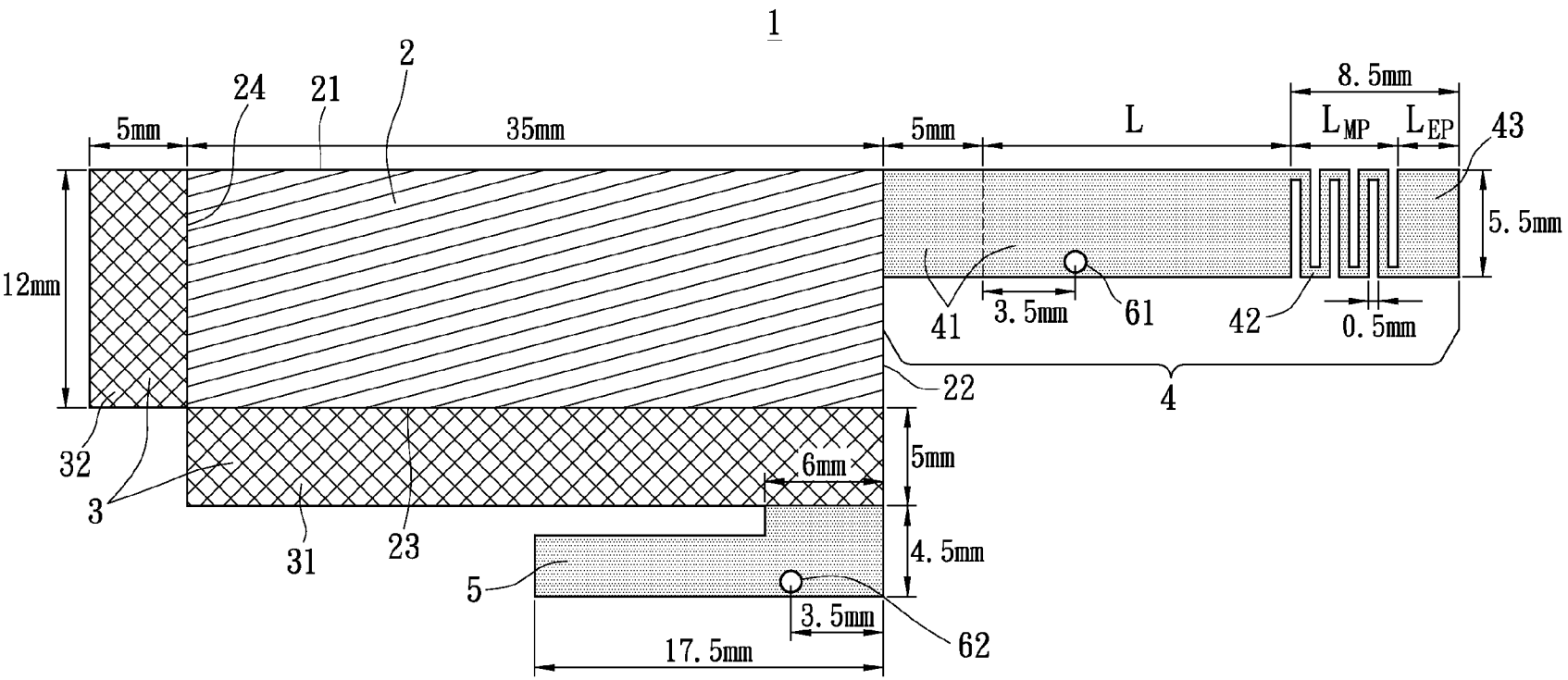
FIG. 2 is a planar diagram showing expansion of a stand-alone multi-band antenna according to an exemplary embodiment of the present disclosure.

Referring to FIG. 2, FIG. 2 is a planar diagram showing expansion of a stand-alone multi-band antenna according to an exemplary embodiment of the present disclosure. The stand-alone multi-band antenna 1 in FIG. 1 is formed by the structure of the metal sheet having the plurality of the beadings as shown in FIG. 2. The first shielding part 31 and the second shielding part 32 are bending with the angle of 90° respectively taking the second long side 23 and the second short side 24 as the pivot axes, so as to form the vertical shielding metal wall 3 as shown in FIG. 1.

The first shielding part 31 is connected to the second radiating unit 5. After the first shielding part 31 and the second shielding part 32 are bending, the second radiating unit 5 is bending with the angle of 90° by taking the connected side of the first shielding part 31 connected to the second radiating unit 5 as the pivot axis, so as to from the second radiating unit 5 vertical to the first shielding part 31 as shown in FIG. 1. After first metal part 41 is bending with the angle of 90° by taking the first short side 22 as the pivot axis, the first metal part 41 is bending with the angle of 90° by taking the bending line (i.e. the dotted line on the first metal part 41, and the distance between the bending line and first short side 22 is 5 millimeters) as the pivot axis, so as form the first radiating unit 4 as shown in FIG. 1.

Still referring to FIG. 1, the shielding metal wall 3 is vertical to the antenna ground plate 2 in the exemplary embodiment of FIG. 1, but the present disclosure is not limited thereto. In the other one exemplary embodiment, it has an angle from 0 through 180° (0° and 180° are not included) between the shielding metal wall 3 and the antenna ground plate 2 in practice, and the stand-alone multi-band antenna in the exemplary embodiments can still reduce the mutual coupling among the fringing-field and the other elements nearby the stand-alone multi-band antenna. However, when the shielding metal wall 3 is designed to be vertical to the antenna ground plate 2, the generated shielding effect is better than that of the other case, and the required height of the shielding metal wall 3 is also less than that of the other case.

In addition, though the antenna ground plate 2 in the exemplary embodiment of FIG. 1 is a rectangular antenna ground plate, the present disclosure is not limited thereto. The antenna ground plate in practice may be polygonal antenna ground plate. Meanwhile, the shielding metal wall 3 must be still designed to limit the fringing-field of the first radiating unit 4 within the stand-alone multi-band antenna 1, therefore the shielding metal wall 3 must connected to a plurality of sides of the polygonal antenna ground plate, and the polygonal antenna ground plate and the shielding metal wall 3 must have the angle not being 0° and 180°. Moreover, the first radiating unit 4 being an antenna structure with the fringing-field may be extended from at least one side of the polygonal antenna ground plate.

In the exemplary embodiment, the terminal end of the first radiating unit 4 and the shielding metal wall 3 have a specific distance therebetween. The smaller the specific distance is, the greater the effect of the fringing-field on the fringing-field metal object nearby the stand-alone multi-band antenna 1 is. Meanwhile, the height of the shielding metal wall 3 (i.e. the vertical distance between the shielding metal wall 3 and the antenna ground plate 2) is larger than or equal to the height of the first radiating unit 4 (i.e. the vertical distance between the shielding metal wall 3 and the antenna ground plate 2). By contrast, the longer the specific distance is, the less the effect of the fringing-field on the fringing-field metal object nearby the stand-alone multi-band antenna 1 is. Meanwhile the height of the shielding metal wall 3 may be less than the height of the first radiating unit 4. In other words, the height of the shielding metal wall 3 is corresponding to the specific distance between the terminal end of the first radiating unit 4 and the shielding metal wall 3, and when the specific distance is larger than a specific value, the height of the shielding metal wall 3 can be less than the height of the first radiating unit 4.

Furthermore, the shielding metal wall 3 may be located nearby the side edge of the first radiating unit 4 (i.e. the side edge may the terminal end, the side, and other open end). Generally speaking, the side edge of the first radiating unit 4 usually still has the fringing-field, and the fringing-field on the terminal end of the first radiating unit 4 is stronger than that on the other location. Thus, in the exemplary embodiment of FIG. 1, the shielding metal wall 3 is located on the second short side 24.

Furthermore, as stated above, the shielding metal wall 3 may be not vertical to the antenna ground plate 2. However, the effective height of shielding metal wall 3 (i.e. the vertical distance between the shielding metal wall 3 and the antenna ground plate 2) is still corresponding to the specific distance between the terminal end of the first radiating unit 4 and the shielding metal wall 3. In other words, if specific distance between the terminal end of the first radiating unit 4 and the shielding metal wall 3 is less than a specific value, the effective height of the shielding metal wall 3 is larger than or equal to the height of the first radiating unit 4. If specific distance between the terminal end of the first radiating unit 4 and the shielding metal wall 3 is larger than a specific value, the effective height of the shielding metal wall 3 is less than or equal to the height of the first radiating unit 4.

In the resonant path of the first radiating unit 4, the bending number of the meandering metal part 42 with the plurality of the beadings and the resonant length may be adjusted to efficiently control the operating frequency ratio of the first operating band and the second operating band excited by the first radiating unit 4. The length of the second radiating unit 5 is about 0.25 wavelength of the central frequency of the third operating band.

For example, to make the first operating band and the second operating band respectively be the 2.4 GHz operating band (central frequency thereof is 2442 MHz) and the 5.8 GHz operating band (central frequency thereof is 5775 MHz), the bending number of the meandering line 42 and the resonant length are adjusted to control the operating frequency ratio of the first operating band and the second operating band to be 1:2. In addition, the length of the second radiating unit 5 can be also adjusted to make the third operating band be the 5.2 GHz operating band (central frequency thereof is 5250 MHz). Accordingly, the third operating band and the second operating band can be combined to form a wider operating band, such that the stand-alone multi-band antenna 1 can perform the multi-band operation (i.e. operating in the 2.4 GHz, 5.2 GHz and 5.8 GHz operating bands).

Figure 3:
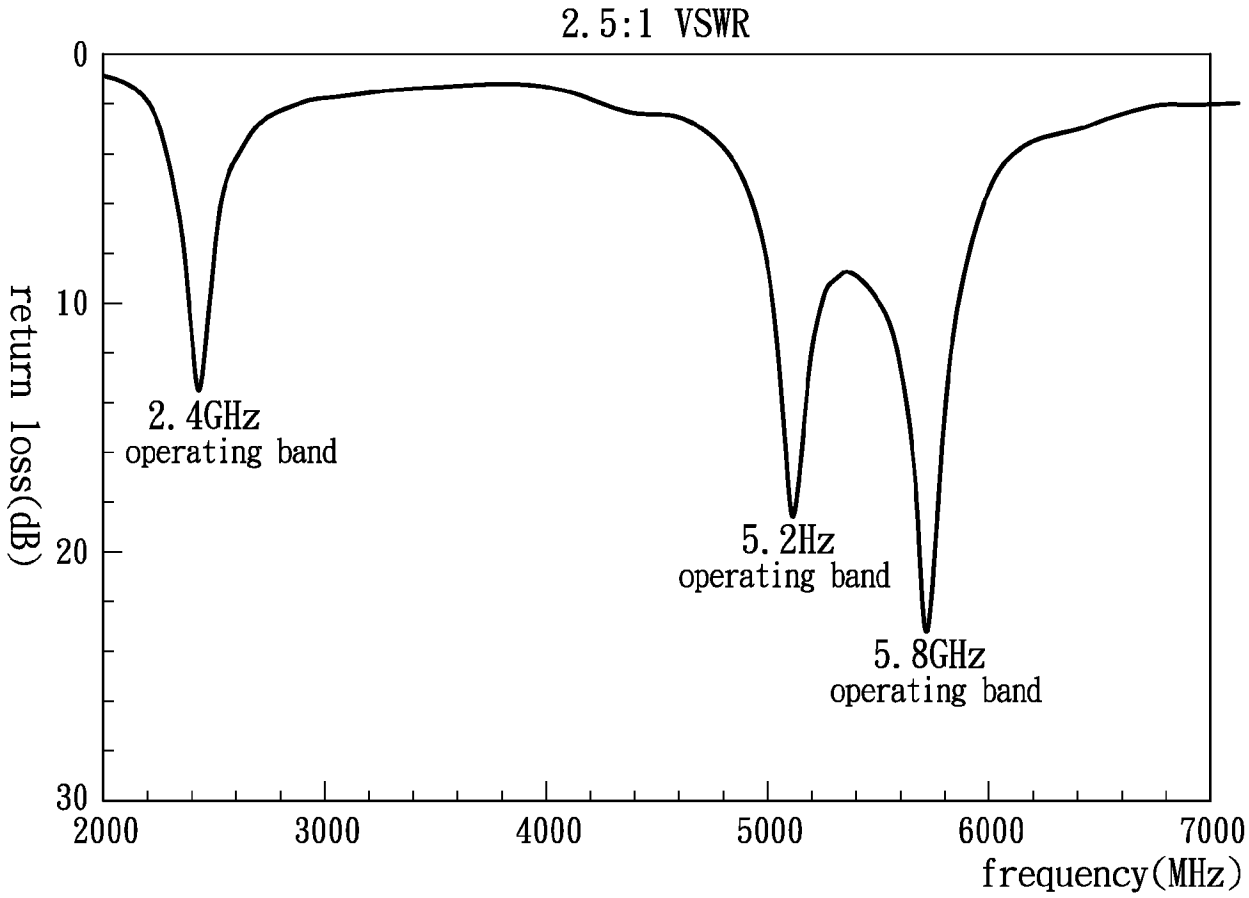
FIG. 3 is a curve diagram showing a return loss of a stand-alone multi-band antenna according to an exemplary embodiment of the present disclosure.

Referring to FIG. 3, FIG. 3 is a curve diagram showing a return loss of a stand-alone multi-band antenna according to an exemplary embodiment of the present disclosure. The return loss in FIG. 3 is measured under the case that the voltage standing wave ratio (VSWR) is 2.5:1. From FIG. 3, it is known that the stand-alone multi-band antenna 1 in FIG. 1 can be operated in the 2.4 GHz, 5.2 GHz and 5.8 GHz operating bands. Furthermore, the impedance and the bandwidth of stand-alone multi-band antenna 1 can satisfy the requirements of the 7.3 dB return loss.

Figure 4:
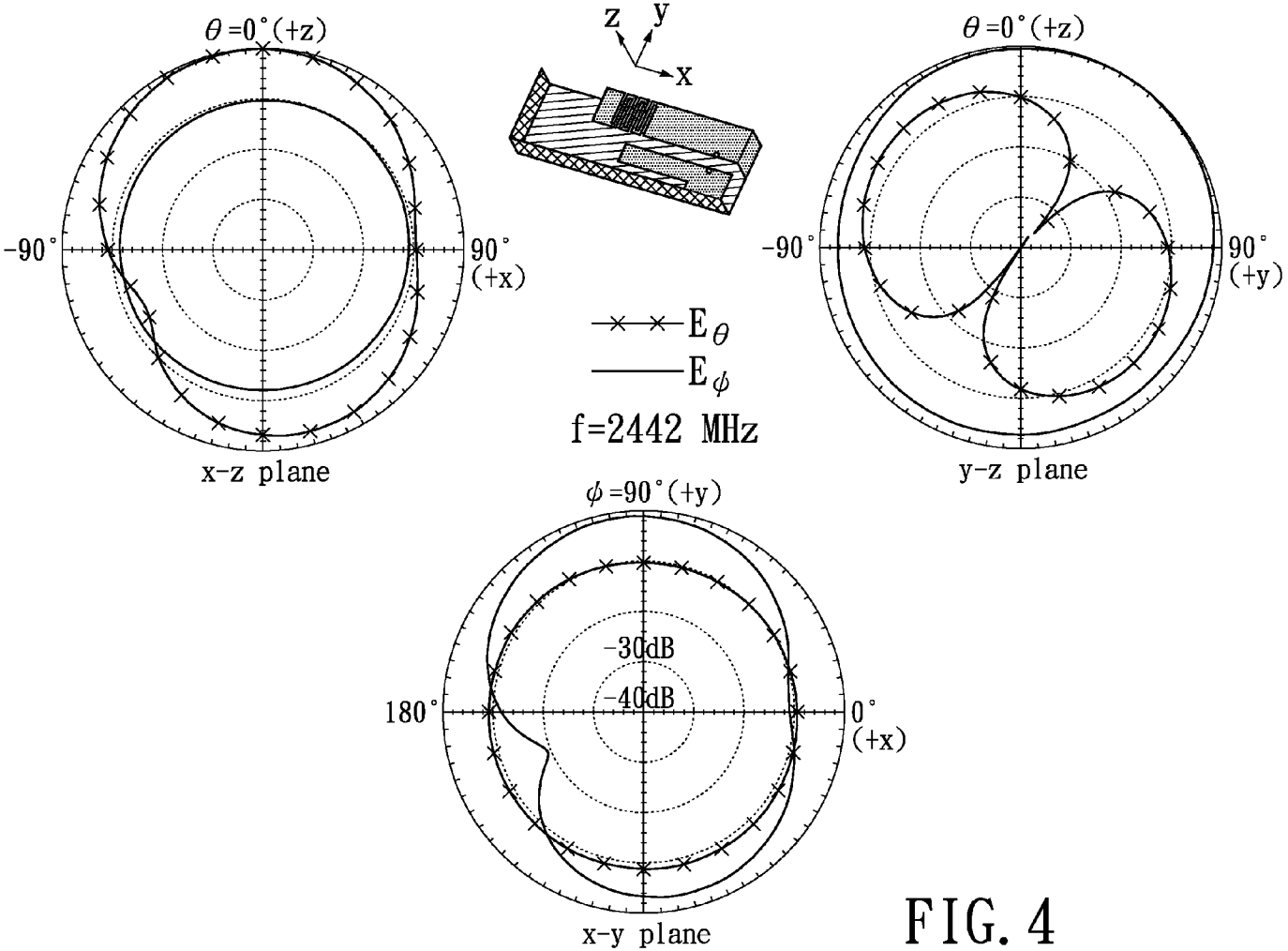
FIG. 4 is a radiation pattern diagram showing a ration pattern of stand-alone multi-band antenna according to an exemplary embodiment of the present disclosure when the stand-alone multi-band antenna operates at the 2442 MHz, central frequency of the 2.4 GHz operating band.

Referring to FIG. 4, FIG. 4 is a radiation pattern diagram showing a ration pattern of stand-alone multi-band antenna according to an exemplary embodiment of the present disclosure when the stand-alone multi-band antenna operates at the 2442 MHz, central frequency of the 2.4 GHz operating band. In FIG. 4, the stronger one of the $E_\theta$ and $E_\phi$ curves of is the main polarization curve, and the weaker one is the cross polarization curve. From the radiation patterns of the x-z plane, the y-z plane, and the x-y plane of the FIG. 4, quasi-omnidirectional antenna radiation patterns in three planes can be observed when operating the 2442 MHz central frequency.

Figure 5:
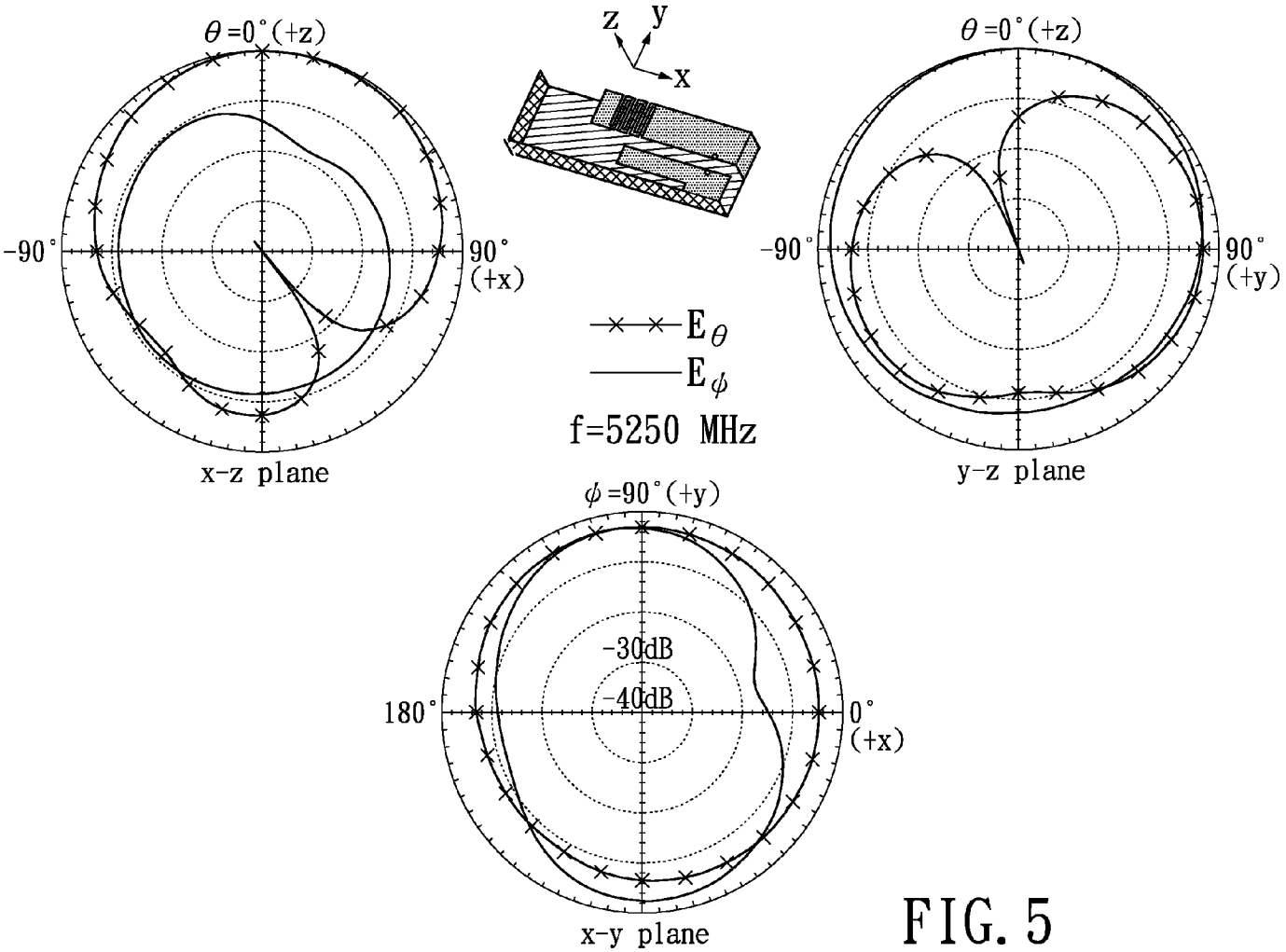
FIG. 5 is a radiation pattern diagram showing a ration pattern of stand-alone multi-band antenna according to an exemplary embodiment of the present disclosure when the stand-alone multi-band antenna operates at the 5250 MHz, central frequency of the 5.2 GHz operating band.

Referring to FIG. 5, FIG. 5 is a radiation pattern diagram showing a ration pattern of stand-alone multi-band antenna according to an exemplary embodiment of the present disclosure when the stand-alone multi-band antenna operates at the 5250 MHz central frequency of the 5.2 GHz operating band. In FIG. 5, the stronger one of the $E_\theta$ and $E_\phi$ curves of is the main polarization curve, and the weaker one is the cross polarization curve. From the radiation patterns of the x-z plane, the y-z plane, and the x-y plane of the FIG. 5, quasi-omnidirectional antenna radiation patterns in three planes can be observed when operating the 5250 MHz, central frequency of the 5.2 GHz operating band.

Figure 6:
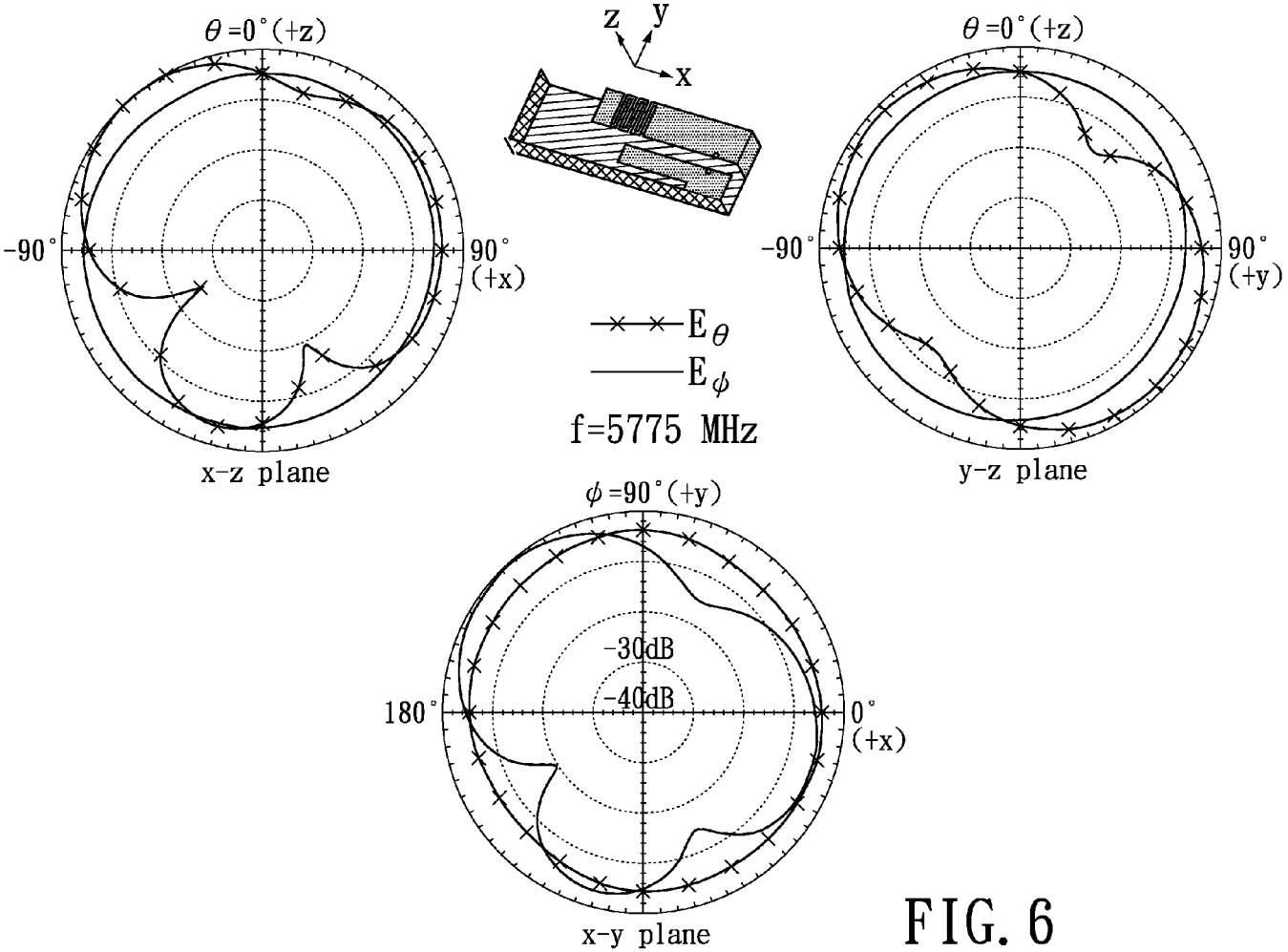
FIG. 6 is a radiation pattern diagram showing a ration pattern of stand-alone multi-band antenna according to an exemplary embodiment of the present disclosure when the stand-alone multi-band antenna operates at the 5775 MHz, central frequency of the 5.8 GHz operating band.

Referring to FIG. 6, FIG. 6 is a radiation pattern diagram showing a ration pattern of stand-alone multi-band antenna according to an exemplary embodiment of the present disclosure when the stand-alone multi-band antenna operates at the 5775 MHz, central frequency of the 5.8 GHz operating band. In FIG. 6, the stronger one of the $E_\theta$ and $E_q$, curves of is the main polarization curve, and the weaker one is the cross polarization curve. From the radiation patterns of the x-z plane, the y-z plane, and the x-y plane of the FIG. 6, quasi-omnidirectional antenna radiation patterns in three planes can be observed when operating the 5775 MHz, central frequency of the 5.8 GHz operating band.

Figure 7:
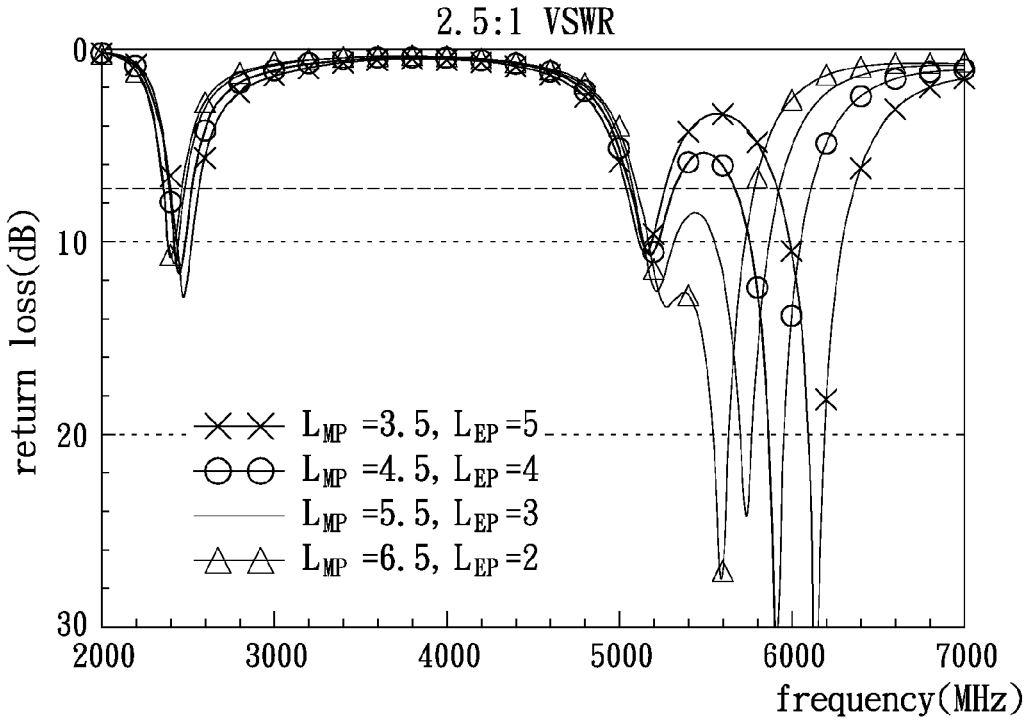
FIG. 7 is a curve diagram showing a return loss of a stand-alone multi-band antenna according to an exemplary embodiment of the present disclosure.

Referring to FIG. 1 and FIG. 7, FIG. 7 is a curve diagram showing a return loss of a stand-alone multi-band antenna according to an exemplary embodiment of the present disclosure. Though the summating length of the length $L_{MP}$ and the length $L_{EP}$ is 8.5 millimeters, the length $L_{MP}$ of the meandering metal part 42 extending along with the first long side 21 and the length $L_{EP}$ of the second metal part 43 extending the first long side 21 can be adjusted to control the return loss of the stand-alone multi-band antenna 1. From FIG. 7, it is known that when the length $L_{MP}$ of the meandering metal part 42 extending along with the first long side 21 increases, the return loss of the third operating band increases, the central frequency of the third operating band slightly increases, the return loss of the second operating band almost does not change, but the central frequency of the second operating band decreases dramatically. From FIG. 7, it can be found that the lengths $L_{MP}$ and $L_{EP}$ can be designed to be 5.5 millimeters and 3 millimeters, so as to make the second operating band and the third operating band cover the 5.8 GHz and 5.2 GHz communication bands.

Figure 8:
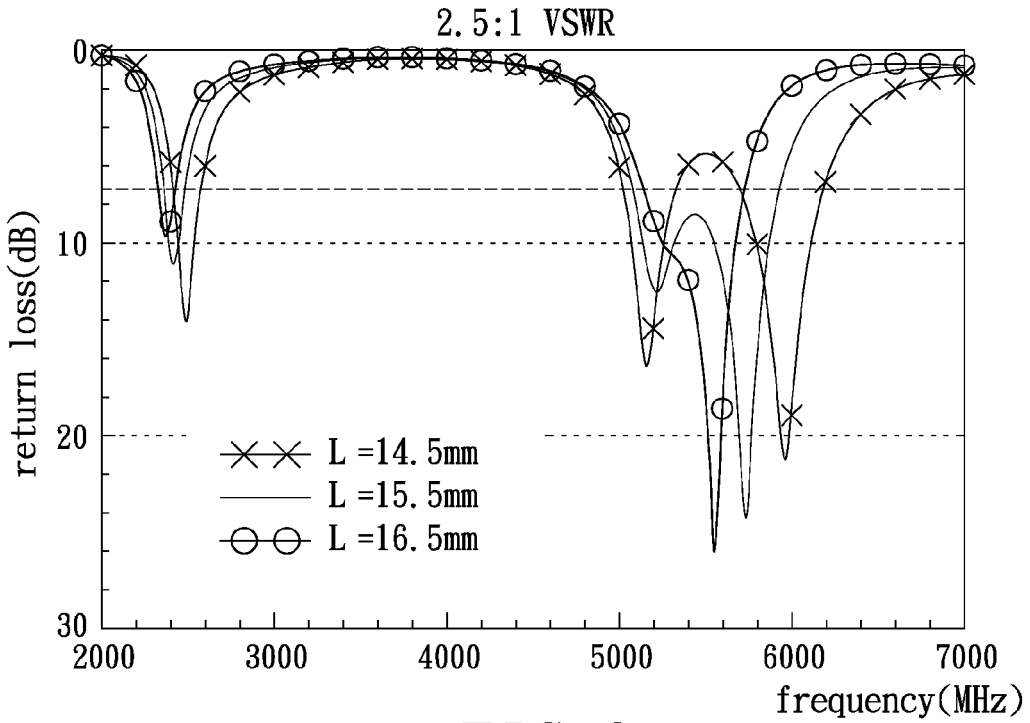
FIG. 8 is a curve diagram showing a return loss of a stand-alone multi-band antenna according to an exemplary embodiment of the present disclosure.

Referring to FIG. 1 and FIG. 8, FIG. 8 is a curve diagram showing a return loss of a stand-alone multi-band antenna according to an exemplary embodiment of the present disclosure. The length L of the first metal part 41 extending along with the first long side 21 may be adjusted to control the central frequencies of the first through third operating bands. From FIG. 8, it is known that when the length L increases, the central frequencies of first and second operating bands decrease obviously, and the central frequency of the third operating frequency increases slightly. From FIG. 8, it can be found that the lengths L can be designed to be 15.5 millimeters, so as to make the first through third operating bands cover the 2.4 GHz, 5.8 GHz, and 5.2 GHz communication bands.

Figure 9:
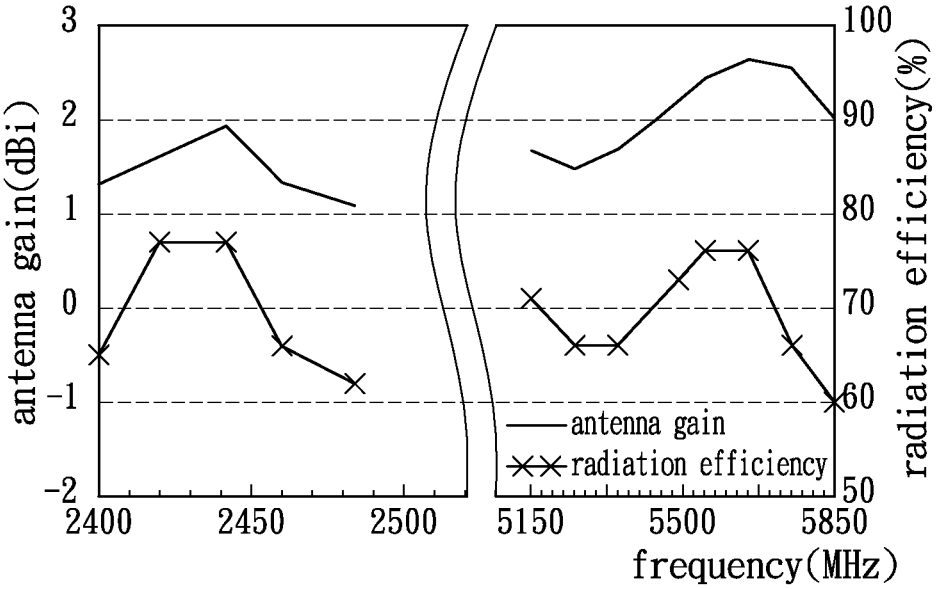
FIG. 9 is a curve diagram showing an antenna gain and radiation efficiency of a stand-alone multi-band antenna according to an exemplary embodiment of the present disclosure.

Referring to FIG. 9, FIG. 9 is a curve diagram showing an antenna gain and radiation efficiency of a stand-alone multi-band antenna according to an exemplary embodiment of the present disclosure. The measured antenna gain and measured radiation efficiency of the stand-alone multi-band antenna 1 in FIG. 1 are shown in FIG. 9. From FIG. 9, it can be seen that the antenna gains at the 2.4 GHz, 5.2 GHz, and 5.8 GHz operating bands can be larger than 1 dBi, and the radiation efficiency at the 2.4 GHz, 5.2 GHz, and 5.8 GHz operating bands can be more than 60%.

[Other Exemplary Embodiment of Stand-Alone Multi-Band Antenna]

Figure 10:
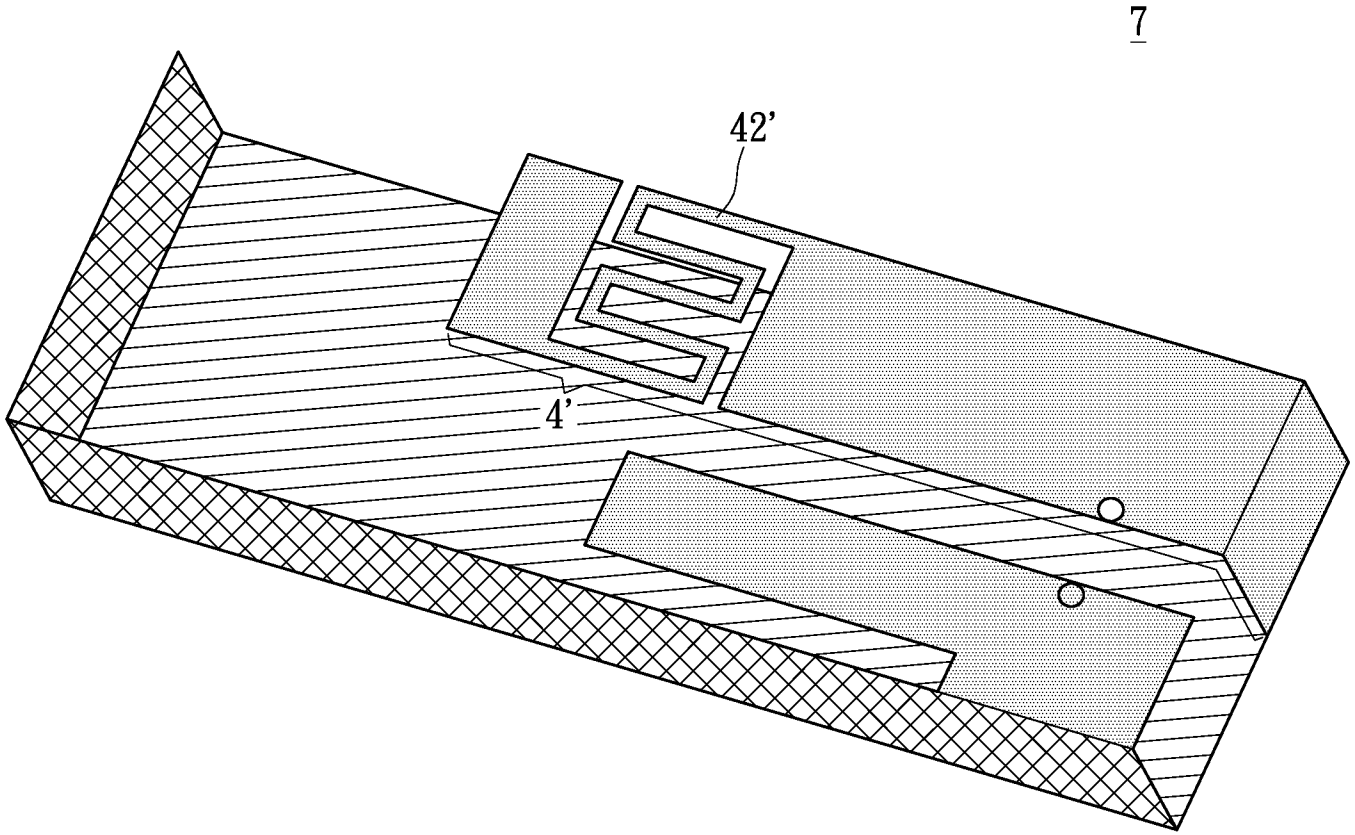
FIG. 10 is a three dimension diagram showing a stand-alone multi-band antenna according to another one exemplary embodiment of the present disclosure.

Referring to FIG. 10, FIG. 10 is a three dimension diagram showing a stand-alone multi-band antenna according to another one exemplary embodiment of the present disclosure. The difference between the stand-alone multi-band antenna 7 in FIG. 10 and the stand-alone multi-band antenna 1 in FIG. 1 is that the meandering line's meandering direction of the of the meandering metal part 42' of the first radiating unit 4' in FIG. 10 is different from the meandering line's meandering direction of the meandering metal part 42 of the first radiating unit 4 in FIG. 1. From the exemplary embodiment of FIG. 10, it is known that the meandering direction of the meandering line is not used to limit the present disclosure.

[Other Exemplary Embodiment of Stand-Alone Multi-Band Antenna]

Figure 11:
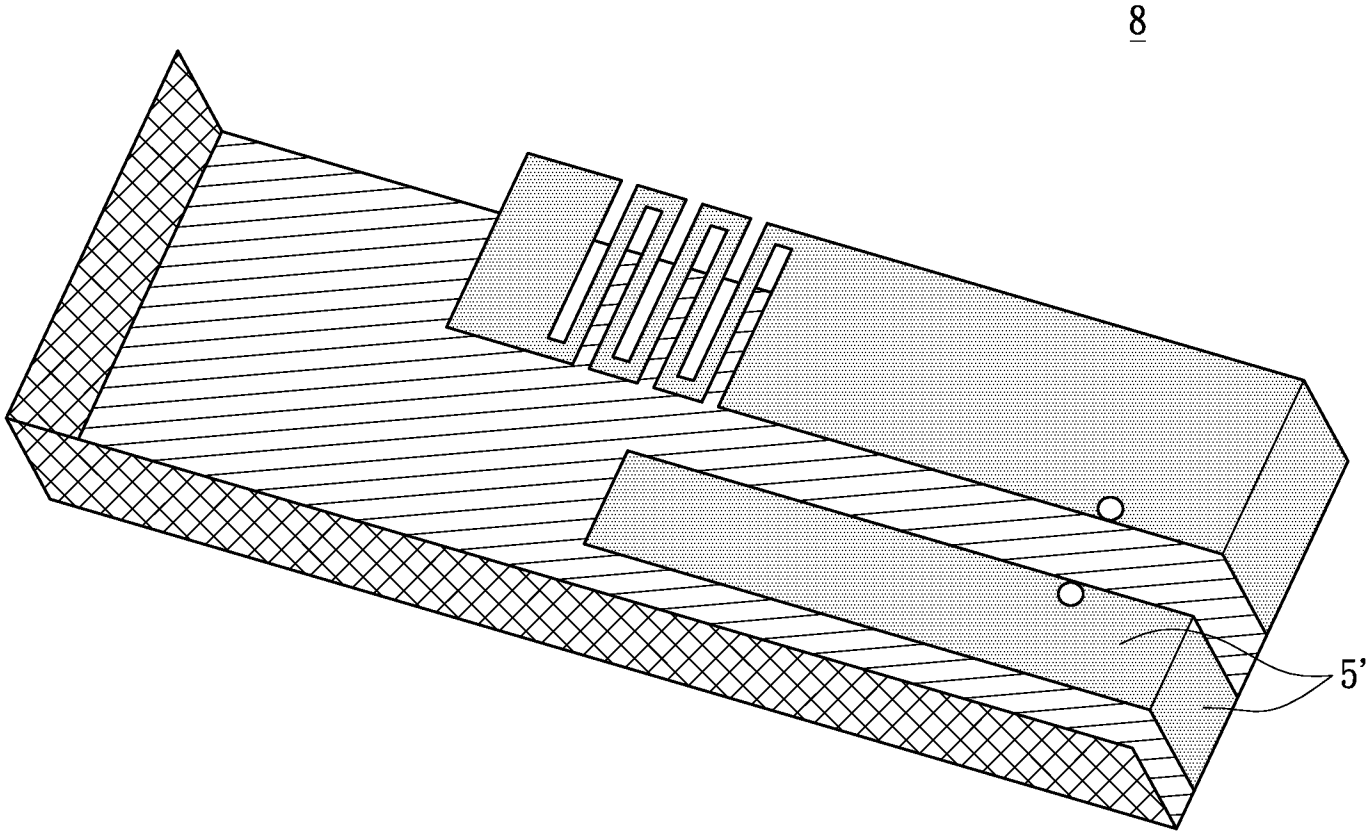
FIG. 11 is a three dimension diagram showing a stand-alone multi-band antenna according to another one exemplary embodiment of the present disclosure.

Referring to FIG. 11, FIG. 11 is a three dimension diagram showing a stand-alone multi-band antenna according to another one exemplary embodiment of the present disclosure. The difference between the stand-alone multi-band antenna 8 in FIG. 11 and the stand-alone multi-band antenna 1 in FIG. 1 is that the second radiating unit 5' in FIG. 11 is not the parasitic metal sheet of the shielding metal wall, and the second radiating unit 5' has at least one bending, wherein one end of the second radiating unit 5' is connected to a part of first short side of the antenna ground plate, and a part of the second radiating unit 5' is extending along with the first long side of the antenna ground plate (i.e. extending to the second short side of the antenna ground plat). From the exemplary embodiment of FIG. 11, it can be known that the location and the dimension of the second radiating unit are not used to limit the present disclosure.

[Other Exemplary Embodiment of Stand-Alone Multi-Band Antenna]

Figure 12:
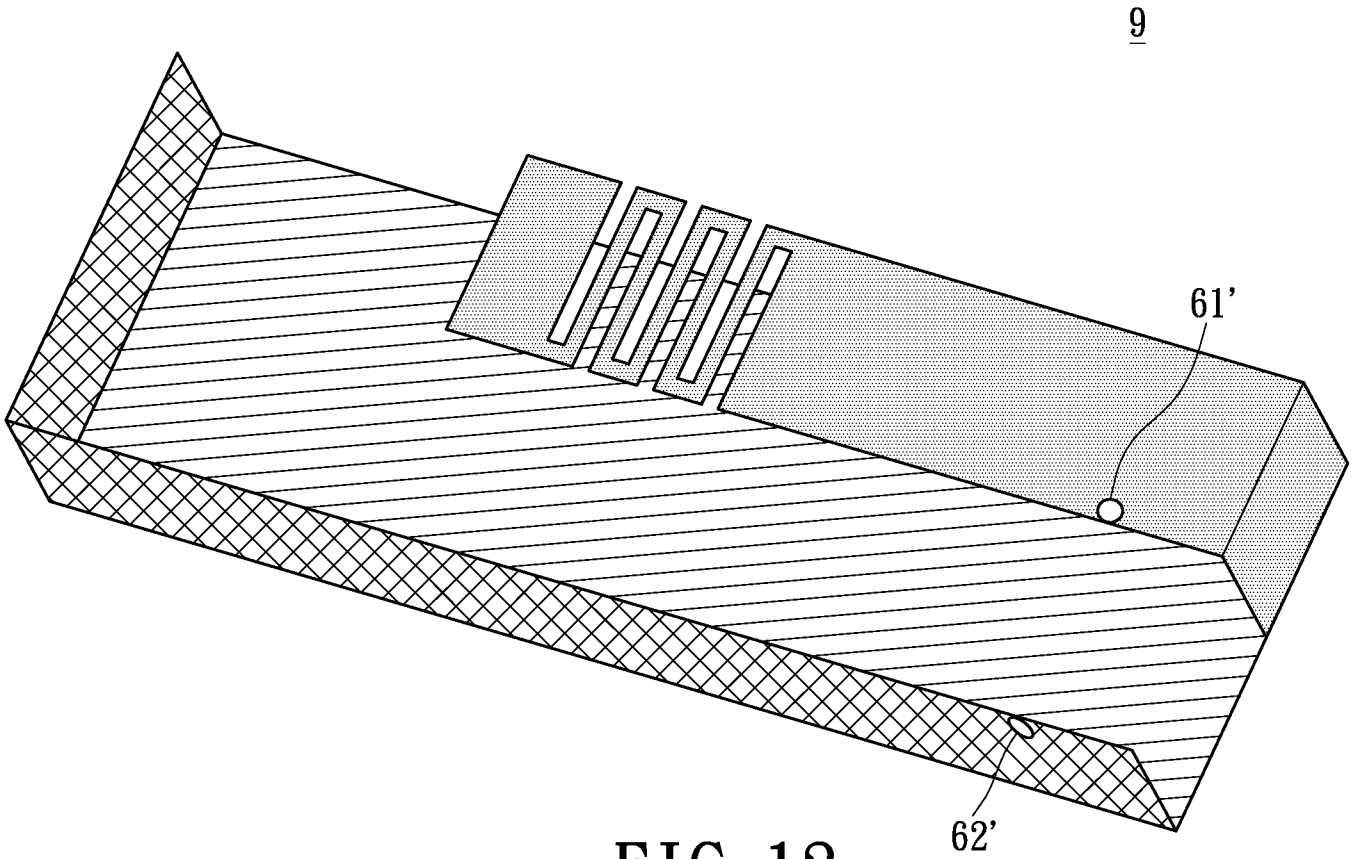
FIG. 12 is a three dimension diagram showing a stand-alone multi-band antenna according to another one exemplary embodiment of the present disclosure.

Referring to FIG. 12, FIG. 12 is a three dimension diagram showing a stand-alone multi-band antenna according to another one exemplary embodiment of the present disclosure. The difference between the stand-alone multi-band antenna 9 in FIG. 12 and the stand-alone multi-band antenna 1 in FIG. 1 is that the stand-alone multi-band antenna 9 in FIG. 12 does not have the second radiating unit, and since the stand-alone multi-band antenna 9 does not have the second radiating unit, the ground point 62' is located on the first shielding part of the shielding metal wall. The ground point 62' of the signal feed-in source is connected to the shielding metal wall, and the signal feed-in point 61' of the signal feed-in source is connected to the first radiating unit. From the exemplary embodiment of FIG. 12, it can be known that the existence of second radiating unit is not used to limit the present disclosure. Moreover, in the other exemplary embodiment, the stand-alone multi-band antenna not only comprises the first and second radiating units, but also comprises the third radiation unit.

[Other Exemplary Embodiment of Stand-Alone Multi-Band Antenna]

Figure 13:
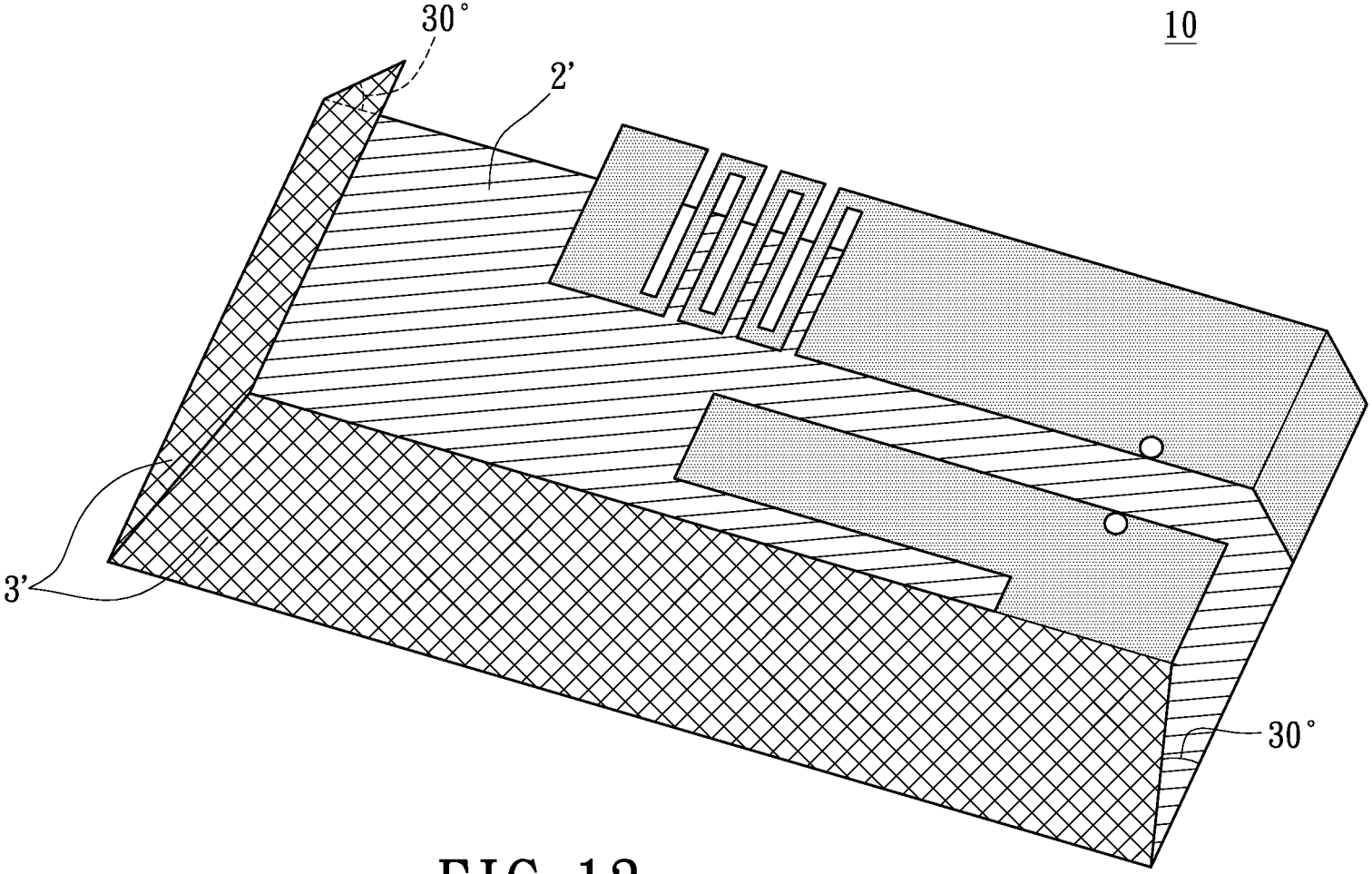
FIG. 13 is a three dimension diagram showing a stand-alone multi-band antenna according to another one exemplary embodiment of the present disclosure.

Referring to FIG. 13, FIG. 13 is a three dimension diagram showing a stand-alone multi-band antenna according to another one exemplary embodiment of the present disclosure. The difference between the stand-alone multi-band antenna 10 in FIG. 13 and the stand-alone multi-band antenna 1 in FIG. 1 is that the shielding metal wall 3' of stand-alone multi-band antenna 10 in FIG. 13 is not vertical to the antenna ground plate 2', and the antenna ground plate 2' and the shielding metal wall 3' have a angle of 30°. However, in the exemplary embodiment, the effective height of the shielding metal wall 3' (i.e. the vertical distance between the shielding metal wall 3' and the antenna ground plate 2') is still larger or equal to the height of the first radiating unit.

[Exemplary Embodiment of Stand-Alone Multi-Band Antenna Applied on Electronic Device]

The stand-alone multi-band antenna can be applied on one of the different electronic devices. Since the stand-alone multi-band antenna has a shielding metal wall, even a shielding metal wall vertical to the antenna ground plate, to limit the fringing-field generated on the terminal end of the radiating unit within the main structure of the stand-alone multi-band antenna mostly, the effect on the stand-alone multi-band antenna due to the other elements in the electronic device may be reduced.

Figure 14:
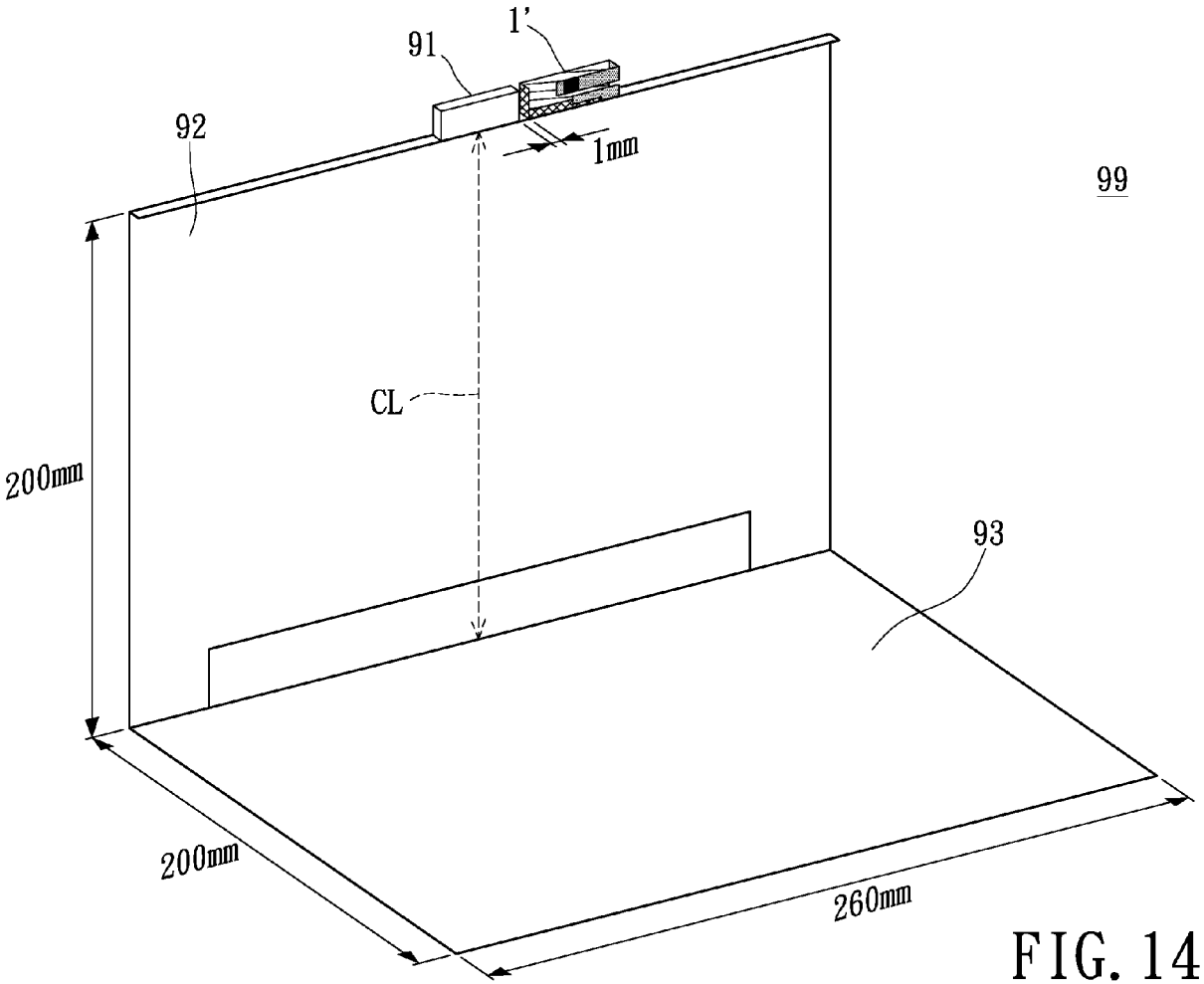
FIG. 14 is a schematic diagram showing a stand-alone multi-band antenna applied on a notebook according to an exemplary embodiment of the present disclosure.

Referring to FIG. 14, FIG. 14 is a schematic diagram showing a stand-alone multi-band antenna applied on a notebook according to an exemplary embodiment of the present disclosure. The notebook 99 has an electronic device 91, a supporting ground plate 92, a main ground plate 93, and a stand-alone multi-band antenna 1', wherein the supporting ground plate 92 is used to support the liquid crystal display panel. The stand-alone multi-band antenna 1' is located nearby the electronic device 91, and the electronic device 91 is located on the center line CL of the supporting ground plate 92. The electronic device 91 and the stand-alone multi-band antenna 1' are located on the top edge of the supporting ground plate 92, and a distance between the electronic device 91 and the stand-alone multi-band antenna 1' is merely 1 millimeter.

In the exemplary embodiment, the impedance and the bandwidth of the stand-alone multi-band antenna 1' can satisfy the requirements of the 7.3 dB return loss (assuming the VSWR is 2.5:1), and the stand-alone multi-band antenna 1' can still have the good radiation property. In addition, it is noted that the stand-alone multi-band antenna 1' may any one of the stand-alone multi-band antennas of the above exemplary embodiments. Furthermore, the notebook 99 may comprise more than one stand-alone multi-band antenna 1', such the notebook 99 is the multiple input multiple output (MIMO) communication system.

[Possible Result of Exemplary Embodiment]

Accordingly, the stand-alone multi-band antenna has the shielding metal wall connected to the antenna ground plate, and the shielding metal wall can efficiently limit the fringing-field of the stand-alone multi-band antenna within the main structure of the stand-alone multi-band antenna, such that the mutual coupling between the fringing-field and the elements nearby the stand-alone multi-band antenna is reduced. In short, the stand-alone multi-band antenna has the ability for resisting the effect due to the variation of the ambient environment. Meanwhile, according to the measured results stated above, the stand-alone multi-band antenna has the good radiation efficiency and the good antenna gain.

Furthermore, compared to the conventional planar inverted-F antenna, the stand-alone multi-band antenna can efficiently generate multiple operating bands without the additional antenna ground plate. Moreover, the stand-alone multi-band antenna has the simple structure and the small dimension, such that the stand-alone multi-band antenna can widely applied in the electronic devices of the different network communication product (such as the notebook, the wireless liquid crystal display device, and the multimedia playing device with the wireless communication function).

By the way, more and more electronic devices of the marketed communication products use the MIMO technology, and the stand-alone multi-band antenna can be further applied in the electronic devices using the multiple input multiple output technology. In other words, the plurality of the stand-alone multi-band antennas can be integrated or embedded in one electronic device. In short, the stand-alone multi-band antenna has more flexible and scalable applications.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. A stand-alone multi-band antenna, comprising:

an antenna ground plate;

a first radiating unit, being an antenna structure generating a fringing-field, directly connected at least one side of the antenna ground plate and located above the antenna ground plate, used to simultaneously provide a first operating band and a second operating band;

a shielding metal wall, connected to a plurality of the adjacent sides of the antenna ground plate, wherein a height of the shielding metal wall is larger than or equal to a height of the first radiating unit, therefore limiting the fringing-field of the first radiating unit within the stand-alone multi-band antenna, wherein the shielding metal wall is formed by extending from the antenna ground plate;

a signal feed-in source, having a signal feed-in point and a ground point, wherein the signal feed-in point is electrically connected to the first radiating unit, and the ground point is electrically connected to the shielding metal wall;

wherein the shielding metal wall is located on neighboring sides of the antenna ground plate neighbored to at least one side of the first radiating unit.

2. The stand-alone multi-band antenna according to claim 1, wherein the shielding metal wall is vertical to the antenna ground plate.

3. The stand-alone multi-band antenna according to claim 2, wherein a shape of the antenna ground plate is rectangular, the antenna ground plate has a first long side, a first short side, a second long side, and a second short side, the shielding metal wall has a first shielding part and a second shielding part, the first shielding part is neighbored to the second shielding part, and the first shielding part and the second shielding part are respectively connected to the second long side and second short side.

4. The stand-alone multi-band antenna according to claim 3, wherein the first radiating unit comprises:

a first metal part, having at least one bending, one end thereof is connected to the first short side, and the other end thereof is extending to the second short side;

a second metal part, located on the extending direction of the first metal part; and a meandering metal part, located between the first metal part and the second metal part, having a plurality of meandering lines.

5. The stand-alone multi-band antenna according to claim 4, wherein one end of the meandering metal part is connected to one side of the first metal part, and the other end of the meandering metal part is connected to a side of the second metal part.

6. The stand-alone multi-band antenna according to claim 4, further comprising:

a second radiating unit, one end thereof is connected to the shielding metal wall, the other end thereof is extending to the second short side, the part of the second radiating unit extending to the second short side is also extending along with the first long side, and the second radiating unit is used to provide a third operating band;

wherein the ground point is connected to the second radiating unit.

7. The stand-alone multi-band antenna according to claim 6, wherein the shielding metal wall is an L-shaped metal wall, and the second radiating unit is an L-shaped metal sheet.

8. The stand-alone multi-band antenna according to claim 6, wherein a summation length of the second metal part and the meandering metal part extending along with the first long side is 8.5 millimeters.

9. The stand-alone multi-band antenna according to claim 6, wherein the first operating band is about a 2.4GHz operating band, the second operating band is about a 5.8GHz operating band, and the third operating band is about a 5.2GHz operating band.

10. The stand-alone multi-band antenna according to claim 6, wherein the stand-alone multi-band antenna is formed a metal sheet which are bended a plurality of times, and the thickness of the metal sheet is 0.3 millimeter.

11. The stand-alone multi-band antenna according to claim 6, wherein the meandering lines are meandered at least three times, and line widths of the meandering lines are 0.5 millimeter.

12. The stand-alone multi-band antenna according to claim 8, wherein lengths of the second metal part and the meandering metal part extending along with the first long side are respectively 3 millimeters and 5.5 millimeters, and a length of the first metal part extending along with the first long side is 15.5 millimeters, and a distance between the first radiating unit and the second radiating unit is 2 millimeters.

13. The stand-alone multi-band antenna according to claim 6, wherein the second radiating unit is a parasitic metal sheet of the shielding metal wall, the parasitic metal sheet is connected to the shielding metal wall, and a length of the parasitic metal sheet extending along with the first long side is 17.5 millimeters.

14. The stand-alone multi-band antenna according to claim 6, wherein the second radiating unit is bent at least once, and one end of the second radiating unit is connected to the first short side, and the other end of the second radiating unit is extending to the second short side.

15. The stand-alone multi-band antenna according to claim 6, wherein a distance between a projection of the signal feed-in point on the antenna ground plate and the first short side is 3.5 millimeters, and a distance between a projection of the ground point on the antenna ground plate and the first short side is 3.5 millimeters.

16. A stand-alone multi-band antenna, comprising:

an antenna ground plate;

a first radiating unit, being an antenna structure generating a fringing-field, directly connected at least one side of the antenna ground plate and located above the antenna ground plate, used to simultaneously provide a first operating band and a second operating band;

a shielding metal wall, connected to a plurality of the adjacent sides of the antenna ground plate, wherein a height of the shielding metal wall is corresponding to a specific distance between the first radiating unit and the shielding metal wall, so as to limit the fringing-field of the first radiating unit in the stand-alone multi-band antenna, wherein the shielding metal wall is formed by extending from the antenna ground plate;

a signal feed-in source, having a signal feed-in point and a ground point, wherein the signal feed-in point is electrically connected to the first radiating unit, and the ground point is electrically connected to the shielding metal wall;

wherein the shielding metal wall is located on neighboring sides of the antenna ground plate neighbored to at least one side of the first radiating unit.

17. The stand-alone multi-band antenna according to claim 16, wherein when the specific distance between the first radiating unit and the shielding metal wall is larger than a specific value, the height of the shielding metal wall is designed to be less than a-height of the first radiating unit, and when the specific distance between the first radiating unit and the shielding metal wall is not larger than the specific value, the height of the shielding metal wall is designed to be larger than or equal to the height of the first radiating unit.

18. The stand-alone multi-band antenna according to claim 17, wherein the shielding metal wall is vertical to the antenna ground plate, and a shape of the antenna ground plate is rectangular, the antenna ground plate has a first long side, a first short side, a second long side, and a second short side, the shielding metal wall has a first shielding part and a second shielding part, the first shielding part is neighbored to the second shielding part, and the first shielding part and the second shielding part are respectively connected to the second long side and second short side.

19. The stand-alone multi-band antenna according to claim 18, wherein the first radiating unit comprises:

a first metal part, having at least one bending, one end thereof is connected to the first short side, and the other end thereof is extending to the second short side;

a second metal part, located on the extending direction of the first metal part; and a meandering metal part, located between the first metal part and the second metal part, having a plurality of meandering lines;

wherein one end of the meandering metal part is connected to one side of the first metal part, and the other end of the meandering metal part is connected to the other side of the second metal part.

* * * * *